US005238061A

United States Patent [19]

Strihafka et al.

[11] Patent Number: 5,238,061

[45] Date of Patent: Aug. 24, 1993

[54] APPARATUS FOR ROTATING A BIT IN A WELL

[75] Inventors: Louis A. Strihafka, Acworth; Howard E. Johnson, Jr., Kennesaw, both of Ga.; Brian K. Moore, Humble, Tex.

[73] Assignee: Camco International Inc., Houston, Tex.

[21] Appl. No.: 953,405

[22] Filed: Sep. 29, 1992

[51] Int. Cl.[5] ..... E21B 37/00

[52] U.S. Cl. ..... 166/170

[58] Field of Search ..... 166/170–176; 175/69, 71

[56] References Cited

U.S. PATENT DOCUMENTS 5,168,929 12/1992 Galloway ..... 166/170 X

*Primary Examiner*—Thuy M. Bui

*Attorney, Agent, or Firm*—Fulbright & Jaworski

[57] ABSTRACT

A gas operated apparatus having a gas supply supplying gas power, a stabilizer for aligning the apparatus in a well, a gas powered motor connected to the conduit for actuating the motor and a bit driven by the motor for rotating in a well. The motor includes a gas inlet, a pressure regulator, a governor, a vane rotor and stator, planetary gears and a power output for rotating the bit at a proper rpm and torque.

5 Claims, 1 Drawing Sheet

APPARATUS FOR ROTATING A BIT IN A WELL

BACKGROUND OF THE INVENTION

The present invention is directed to a gas powered motor for rotating a bit for operation in a well for various functions.

For example, scale usually accumulates during steam production in geothermal well bore production strings. This scale buildup restricts flow and will eventually cause the well to stop producing. Therefore, the scale on the inside of the well production string must be periodically removed.

Various equipment has been tried for removing scale. High temperatures in geothermal wells preclude the use of conventional mud motors. The dynamic elastomer seals in such motors is affected by the high temperatures causing failure. Also fluid operated mud pump motors pump mud into the well causing the hydrostatic pressure in the well to become greater than the down hole pressure and results in killing the well. Success with vibratory impact motors is limited because the scale is broken instead of sheared. Scale which is broken in large fragments cannot be circulated completely out of the well and the scale will tend to fall back on the apparatus and create problems. Drilling rigs are another option used in scale cleanouts. Although drilling rigs are successful, they are quite expensive in most cases.

While gas driven motors have been attempted in the past, they have failed and have not been successful. The present application is directed to a gas powered apparatus, which will rotate a mill at a proper rpm and torque and control and limit these parameters in the hostile environment prevalent in geothermal wells. The rotating mill permits the scale to be sheared instead of broken allowing scale fragments to be efficiently circulated out of the well bore, the temperature effects on the apparatus is greatly reduced by the elimination of dynamic elastomer seals, and the motor is gas operated, such as by air or nitrogen, to eliminate the chances of killing the well by the actuating fluid.

SUMMARY OF THE INVENTION

The present invention is directed to a gas operated apparatus for rotating a bit in a well and includes a gas supply conduit for supplying gas power, a stabilizer for centralizing and stabilizing the apparatus in the interior of the production string, a gas powered motor connected to the stabilizer and in communication with the gas supply conduit for actuating the motor, and a mill connected to and rotated by the motor for milling scale. The motor includes a gas inlet, a pressure regulator, a governor, a vane rotor and stator, speed reducing gears, and a power output. The pressure regulator is connected to the gas inlet and limits the gas pressure to the vane rotor, thus limiting torque. The governor is connected to and limits the speed of the rotor. The gears are connected between the rotor and output, and reduce the output speed. The output is connected to and rotates the mill.

Another object of the present invention is wherein the pressure regulator includes a regulator spool controlling the passage of gas through the gas inlet and a regulator piston engaging the spool and having first and second sides. The piston is exposed to inlet gas pressure on the first side and exposed to exhaust gas pressure from the vane rotor and stator on the second side for controlling the pressure regulator spool, thereby limiting the differential pressure across the rotor vanes. Preferably, the regulator includes an adjustable biasing means connected to the piston for adjusting the regulation of the inlet gas pressure.

Yet a still further object of the present invention is wherein the governor includes a spool valve connected to the gas inlet downstream of the pressure regulator, has a spindle connected to the vane rotor, and includes a centrifugal actuator connected to and controlling the position of the spool valve.

Other and further objects, features and advantages will be apparent from the following description of a presently preferred embodiment of the present invention, given for the purpose of disclosure, and taken in conjunction with the accompanying drawings.

DESCRIPTION OF THE PREFERRED EMBODIMENTS

While the present invention will be described in its use as removing scale build up in geothermal wells, for purposes of illustration only, the present invention is useful for rotating a bit in a well for other uses, or even drilling a well.

Figure 1:
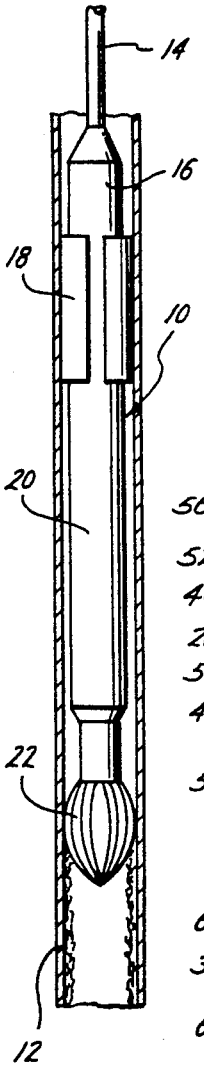
FIG. 1 is an elevational view, schematically illustrating the use of the present invention in a well production string.
Figure 2A:
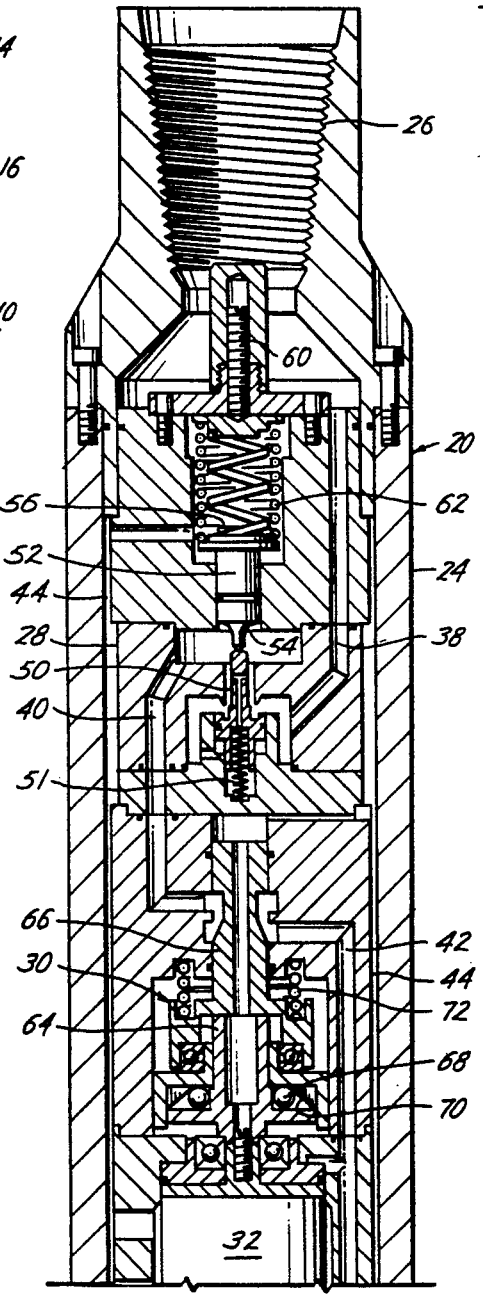
FIGS. 2A and 2B are continuations of each other and form an elevational view, in cross-section, of the gas operated motor utilized in the present invention.
Figure 2B:
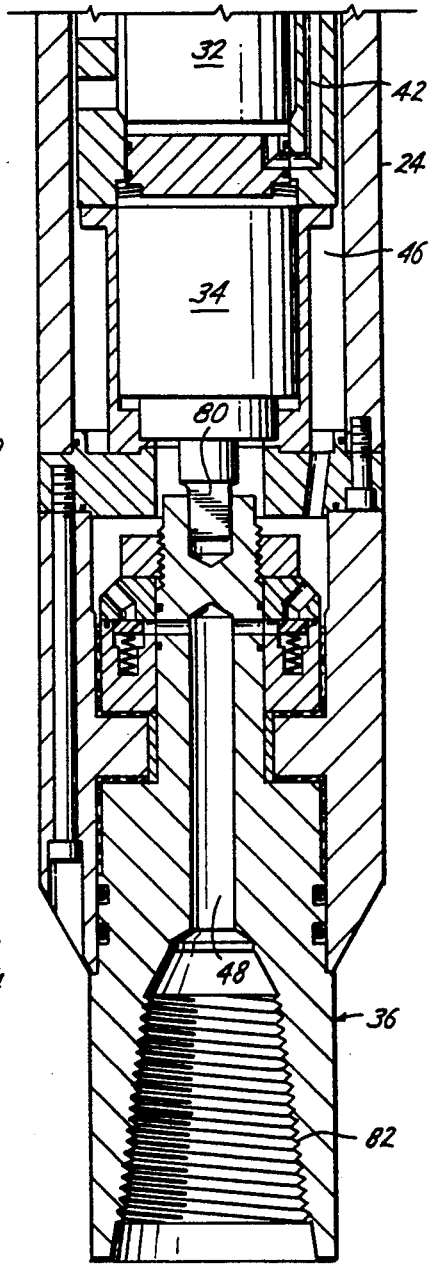

Referring now to drawings, and particularly to FIG. 1, the reference numeral 10 generally indicates the apparatus of the present invention for milling scale from the inside of a well production string 12, such as the production string of a geothermal well. Such wells are operated at high temperatures, high volumes and scale usually accumulates during steam production on the inside of the production string 12, which will buildup and restrict flow and eventually cause the well to stop producing unless the scale is removed. The apparatus 10 includes a gas supply conduit such as coiled tubing 14, a connector 16, a stabilizer 18, a motor 20, and a bit or mill 22.

While the gas supply conduit 14 may be any suitable type of conduit and gas, it is preferred that the conduit be a conventional coiled tubing which is operated from a reel to support and move the apparatus 10 through the production string 12. Such a coiled tubing avoids the use of using an expensive drilling rig for providing the routine maintenance of removing the scale in the wells. And while any suitable gas supply may be used, air or nitrogen is preferred for powering the motor 20 as the use of gas eliminates the possibility of killing the well as might occur in the use of a liquid operated motor, such as a mud motor. The connection 16, the stabilizer 18, and the milling tool 22 may be any suitable conventional components. A variety of bits and mills can be used, which include a tapered, flatbottom or underreamer type as the well characteristics determine the type and design of mill that should be used.

While gas operated motors have been suggested in the past, none have been successful, as they did not have the ability to rotate a mill within proper rpm limits and torque requirements in the hostile environment prevalent in geothermal wells.

Referring now to drawings 2A and 2B, the motor 20 includes a housing 24, a gas inlet 26, a pressure regulator 28, a governor 30, a vane rotor and stator 32, reduction gears 34 and a power output 36.

The pressure regulator 28 limits the pressure differential across the vanes of the rotor and stator 32, thereby limiting the output torque. This feature is significant, particularly when the apparatus 10 may be conveyed in a variety of gas conduits 14 having different strengths. That is, the output torque must be limited in order to prevent failure of the conduit 14. The pressure regulator controls the passage of gas through the inlet 26, which includes passageways 38, 40, 42, leading to the vane rotor and stator 32 and exhaust passageways 44, 46 and 48 leading to the mill 22. The regulator 28 includes a regulator spool 50 having a spring 51, such as a barns spring, which biases the spool 50 in a direction closing communication between the passageways 38 and 40, thereby blocking flow of gas to the rotor and stator 32. The regulator 28 also includes a regulator piston 52. The piston 52 includes a first side 54 and a second side 56. The first side 54 is exposed to the inlet pressure in the passageway 38 and the second side 56 is exposed to the exhaust passageway 44 from the vane rotor and stator 32. If the pressure differential across the piston 52 is lower than a preset differential setting, the gas will flow through the pressure regulator 28 towards the vane rotor and stator 32. If the differential pressure across the piston 52 is greater than the setting, pressure forces the piston 52 to upwardly allowing the springs 51 to push the spool 50 to a closed position, thus restricting gas flow to the vane rotor and stator 32, limiting the torque output. This feature allows the regulator spool 50 to open and close, maintaining the desired differential pressure. The desired differential pressure is determined by the coiled tubing 14 torque limitations and generally a linear relationship exists between torque and differential.

An adjustable biasing means is connected to the piston 52 for regulating the inlet gas pressure. Thus, the pressure differential or actuation of the piston 52 is set by adjusting a screw 60, which applies a force to the piston 52 by compressing springs, such as barnes springs 62. Thus, the pressure regulator may be conveniently set prior to use.

The pressurized gas flowing in the passageway 40 from the pressure regulator 28 flows through the governor 30 and actuates the vane rotor and stator 32, which may be a beefed up Ingersol-Rand gas motor. The shaft of the rotor is connected to and rotates the spindle 64 of the governor 30. The governor 30 utilizes the rotation of the spindle 64 to actuate a centrifugal actuator to control the governor 30. Thus, the governor includes a spool valve 66, which is connected in the gas inlet between the passageway 40 and 42 downstream of the pressure regulator 28. Rotation of the spindle 64 acts on a pair of balls 68, generating a centrifugal force outwardly to act on wedge surfaces 70. As the balls 68 are forced outwardly by centrifugal force, they act on the wedges 70 to apply a force to the valve spool 66. This force drives the spool 66 towards a closed position, reducing gas flow. The movement of the spool 66 is counteracted by the compression force of spring 72. The governor 30 prevents the motor 20 from overspeeding, which occurs when pressurized gas powers a motor under varying pressures and loads. Overspeeding will result in the rapid failure of the vanes in the vane rotor and stator 32.

The output of the vane rotor and stator 32 is connected to the reducing gear section 34. Preferably, this reducing gear consists of two, three planet, stages of gears. The result of these gears is to reduce revolutions of the speed of the rotor shaft and multiply the torque at the output shaft 80. In one example, the gear reduction ratio from the rotor shaft to the gear output shaft 80 is 45:1. the gear output shaft 80 is connected to the output 36, which provides a connection such as threaded connection 82 for receiving the mill 22.

In use, the apparatus 10 is lowered into the well string 12 while gas is supplied from the coil tubing 14 to the motor 20, rotating the mill 22 for removing scale from the inside of the production string 12. Normally, this operation will be performed while the well is being produced, whereby the chips and debris which have been removed are blown out the top of the production string 12 along with the gas used in powering the motor 20.

The present invention, therefore, is well-adapted to carry out the objects and attain the ends and advantages mentioned as well as others apparent therein. While a presently preferred embodiment of the invention has been given for the purpose of disclosure, numerous changes in the detail of construction, and arrangement of parts will be readily apparent to those skilled in the art and which are encompassed in the spirit of the invention and the scope of the appended claims.

What is claimed is:

1. A gas operated apparatus for rotating a bit in a well comprising, a gas supply conduit for supplying gas power, a stabilizer for centralizing the apparatus in the production string, a gas powered motor connected to the stabilizer and in communication with the gas supply conduit for activating the motor, a bit connected to and rotated by the motor, said motor having a gas inlet, a pressure regulator, a governor, a vane rotor and stator, reduction gears, and a power output, said pressure regulator connected to the gas inlet and limiting the gas pressure to the vane rotor, said governor connected to and limiting the speed of the rotor, said gears connected between the rotor and the output and reducing the output speed, and said output connected to the bit.

2. The apparatus of claim 1, wherein said pressure regulator includes, a regulator spool controlling the passage of gas through the gas inlet, a regulator piston having first and second sides and engaging the spool, said piston exposed to inlet gas pressure on the first side and exposed to exhaust gas pressure from the vane rotor and stator on the second side for controlling the pressure regulator spool, thereby limiting the differential pressure across the rotor vanes.

3. The apparatus of claim 2, including an adjustable biasing means connected to the piston for regulating the inlet gas pressure.

4. The apparatus of claim 1, wherein the governor includes a spool valve connected to the gas inlet downstream of the pressure regulator, a spindle connected to the vane rotor, and a centrifugal activator connected to and controlling the position of the spool valve.

5. An apparatus for milling scale from the inside of a geothermal well production string comprising, a coiled tubing for supplying gas power and for providing support, a stabilizer for centralizing and stabilizing the apparatus in the production string, a gas powered motor connected to the stabilizer and in communication with the coiled tubing for activating the motor, a mill connected to and rotated by the motor for milling scale, said motor having a gas inlet, a pressure regulator, a governor, a vane rotor and stator, reduction gears, and a power output, said pressure regulator connected to the gas inlet and limiting the gas pressure to the vane rotor, said governor connected to and limiting the speed of the rotor, said gears connected between the rotor and the output and reducing the output speed, and said output connected to the mill, a regulator spool controlling the passage of gas through the gas inlet, a regulator piston having first and second sides and engaging the spool, said piston exposed to inlet gas pressure on the first side and exposed to exhaust gas pressure from the vane rotor and stator on the second side for controlling the pressure regulator spool, thereby limiting the differential pressure across the rotor vanes, and a spool valve connected to the gas inlet downstream of the pressure regulator, a spindle connected to the vane motor, and a centrifugal activator connected to and controlling the position of the spool valve.

* * * * *